US011162231B2

(12) United States Patent
Wolfrum

(10) Patent No.: US 11,162,231 B2
(45) Date of Patent: Nov. 2, 2021

(54) SOIL-PROCESSING ROLLER

(71) Applicant: Hamm AG, Tirschenreuth (DE)

(72) Inventor: Gerhard Wolfrum, Waldershof (DE)

(73) Assignee: HAMM AG, Tirschenreuth (DE)

( * ) Notice: Subject to any disclaimer, the term of this patent is extended or adjusted under 35 U.S.C. 154(b) by 72 days.

(21) Appl. No.: 16/713,733

(22) Filed: Dec. 13, 2019

(65) Prior Publication Data

US 2020/0190751 A1 Jun. 18, 2020

(30) Foreign Application Priority Data

Dec. 17, 2018 (DE) ..... 10 2018 132 379.4

(51) Int. Cl.

| | |
|---|---|
| ***E01C 19/00*** | (2006.01) |
| ***E01C 19/28*** | (2006.01) |
| ***E01C 21/00*** | (2006.01) |
| *B06B 1/16* | (2006.01) |

(52) U.S. Cl.
CPC ..... *E01C 19/282* (2013.01); *E01C 21/00* (2013.01); *B06B 1/16* (2013.01)

(58) Field of Classification Search
CPC ..... E01C 19/282; E01C 21/00; B06B 1/16
USPC ..... 404/117
See application file for complete search history.

(56) References Cited

U.S. PATENT DOCUMENTS 2,340,031 A * 1/1944 Whiteman ..... E01C 19/281 404/117
9,284,696 B2 * 3/2016 Fischer ..... A01B 29/06
9,725,855 B2 * 8/2017 Kreische ..... E02D 3/074
10,501,903 B2 * 12/2019 Janner ..... E02D 3/026
2017/0016184 A1 * 1/2017 Oetken ..... B06B 1/16

OTHER PUBLICATIONS

German Search Report of DE 2018 132 379.4 dated Dec. 2, 2019, 9 pages (German).
Extended European Search Report of EP 19214673.6 dated May 4, 2020, 5 pages (German).

* cited by examiner

*Primary Examiner* — Raymond W Addie
(74) *Attorney, Agent, or Firm* — Rankin, Hill & Clark LLP

(57) ABSTRACT

A soil-processing roller for a soil-processing machine includes a roller sleeve extending longitudinally in the direction of a roller axis of rotation, surrounding the roller axis of rotation, a first drive transmission element connected or connectable such that it can rotate to a rotor region of a roller drive motor for combined rotation about the roller axis of rotation, a first roller sleeve connecting element connected to the first drive transmission element by means of a plurality of first elastic suspension elements and to the roller sleeve for combined rotation about the roller axis of rotation, a second drive transmission element arranged at an axial distance to the first drive transmission element and connected by means of a drive transmission element connection arrangement to the first drive transmission element for torque transmission and a second roller sleeve connecting element connected to the second drive transmission element by means of a plurality of second elastic suspension elements and connected firmly so that it can rotate to the roller sleeve for combined rotation about the roller axis of rotation.

15 Claims, 5 Drawing Sheets

SOIL-PROCESSING ROLLER

The present invention relates to a soil-processing roller for a soil-processing machine that may, for example, be used to compact loose ground or to break up solid, for example, stony, ground or ground that is built over with concrete materials.

A soil compactor manufactured or sold on the part of Hamm AG under the model designation H18i is shown in FIGS. 1 and 2. This soil compactor 10 comprises a front end 12 with a machine frame 14 and a soil-processing roller 16 supported thereon such that it can rotate. In the region of a steering linkage arrangement 18, the front end 12 is connected to a rear end 20 such that it can swivel about a steering axle. On the rear end 20 are also provided wheels 22 driven by a drive unit and a control panel 24 for a person operating the soil compactor 10.

The machine frame 14 comprises two longitudinal members 26, 28 extending in a longitudinal direction of the machine L and two transverse members 30, 32 arranged mutually spaced in the longitudinal direction of the machine. In the region of the transverse member 32 the machine frame 14 is connected via the steering linkage arrangement 18 to a frame 34 or the rear end 20.

The internal structure of the soil-processing machine 16 also generally designated as a binding is shown in FIG. 2. The soil-processing machine 16 comprises an essentially cylindrically formed roller sleeve 36 extending longitudinally in the direction of a roller axis of rotation D. On both sides of the roller sleeve 36 mounting plates 38, 39 are provided, by which the soil-processing roller 16 is supported on the longitudinal members 26, 28 of the machine frame 14. On the mounting plate 38 shown on the left in FIG. 2 is a stator region 40 of a rigidly-supported roller driver motor generally designated with 42. A rotor region 44 of the roller drive motor 42 formed as a hydraulic motor, such that said region can rotate about the roller axis of rotation D in relation to the stator region 40 supports a drive transmission element 46 formed as a disc. This is connected in its radially-external region by a plurality of sequential elastic suspension elements 48 in the circumferential direction, which may be constructed, for example, of rubber or rubber-elastic material, to a roller sleeve connecting element 50 also formed as an annular disc. The roller sleeve connecting element 50 is in turn connected at several circumferential positions to fastening protrusions 52 provided on the inside of the roller sleeve 36, for example, by screw connection. In this way, in the left region in FIG. 2 the soil-processing roller 16 and/or its roller sleeve 36 is supported elastically in relation to the machine frame 14 and such that it can be rotated about the axis of rotation of the roller D.

On the axial end shown in the right of FIG. 2, a suspension module 54 is firmly supported on the mounting plate 39 and by the same to the longitudinal member 26. The suspension module 54 comprises a first suspension disc 56 that is supported by a member formation 58 on the mounting plate, and furthermore comprises a second suspension disc 60 that is connected via a plurality of elastic suspension elements 62 to the first suspension disc 56. The second suspension disc 60 is, in turn, firmly connected to a stator region 64 of a roller bearing unit generally designated with 66. A rotor region 68 of the roller bearing unit 66 is connected via a housing 70 of the vibration mechanism generally designated with 72 and supporting disc 74 connected on an inner side of the roller sleeve 36, for example, by welding and generally also designated as a round plate, to the roller sleeve 36. Therefore, also in the right axial region in FIG. 2, the soil-processing roller 16 and/or the roller sleeve 36 of the same is elastically-supported in relation to the machine frame 14.

An unbalanced drive motor 76 is fastened to the stator region 64 of the roller bearing unit 66 and/or is firmly connected to the same. The unbalanced drive motor 76 drives an out-of-balance mass 78 arranged in a housing 70 and via this an out-of-balance mass 82 arranged in a further housing 80 into rotation about an out-of-balance axis of rotation, which corresponds to what is known as a vibration roller of the roller axis of rotation D in the illustrated example.

It can be seen in FIG. 2 that in both axial end regions of the soil-processing roller 16 the modules or components selected for elastic suspension of the same in relation to the machine frame 14 are formed markedly different from each other, so that there is an asymmetrical suspension characteristic in the direction of the roller axis of rotation D. Also, the drive torque provided by the roller drive motor 42 is only exerted in the axial end region shown on the left in FIG. 2 into the soil-processing roller. This is connected with the circumstance that due to the structural design there is a non-uniform weight distribution in the direction of the roller axis of rotation D, which may cause a non-uniform operating behaviour of the soil-processing roller 16 over the length of the roller sleeve 36. Whereas non-uniform mass distributions can be compensated by attaching additional weights, for example, on the roller sleeve 36, a compensation for different elastic suspension characteristics of the formations provided in both end regions for suspending the soil-processing roller 16 in relation to the machine frame 14, particularly also due to the circumstances that different quantities of elastic suspension elements 48 and/or 62 are provided and these are arranged at various positions, particularly various radial positions in relation to the roller axis of rotation D, can only be compensated for with difficulty.

A soil-processing roller for a soil-processing machine with the structure described above with reference to FIG. 2 particularly with respect to the elastic suspension of the soil-processing rollers is known from CN 202181498 U.

It is the task of the present invention to provide a soil-processing machine with which a uniform load distribution and suspension characteristic of the soil-processing roller and a uniform exertion of a drive torque into the soil-processing roller is achieved.

According to the invention, this task is solved by a soil-processing roller for a soil-processing machine, comprising:

- A roller sleeve extending in the direction of a roller axis of rotation surrounding the roller axis of rotation,
- A first drive transmission element connected or connectable firmly so that it can rotate to a rotor region of a roller drive motor for combined rotation about the roller axis of rotation,
- A first roller sleeve connecting element connected to the first drive transmission element by means of a plurality of first elastic suspension elements and connected firmly so that it can rotate to the roller sleeve for combined rotation about the roller axis of rotation.

This soil-processing roller is characterised by:

- A second drive transmission element arranged at an axial distance to the first drive transmission element and connected by means of a drive transmission element connection arrangement to the first drive transmission element for torque transmission,
- A second roller sleeve connecting element connected to the second drive transmission element by means of a plurality of second elastic suspension elements and connected firmly so that it can rotate to the roller sleeve for combined rotation about the roller axis of rotation.

The soil-processing roller constructed according to the invention is characterised, compared with the above, with reference to the formations described in the prior art so that the torque is exerted into the soil-processing roller at several regions located at a mutual axial distance. In these regions in which the torque is exerted into the soil-processing roller, and/or the same is transferred to the roller sleeve, via the drive transmission elements arranged at a mutually axial spacing, the soil-processing roller and/or the roller sleeve is also supported and/or suspended. Therefore, not only is a uniform exertion of the torque in the direction of the roller axis of rotation guaranteed, but also an essentially uniform arrangement of the modules provided for this purpose in the region of the torque exertion and support and/or suspension is enabled. This in turn leads to an essentially uniform suspension characteristic in both regions providing the elastic suspension of the soil-processing roller.

For a stable formation but at the same time requiring little installation space, it may be provided that the first drive transmission element and/or the second drive transmission element and/or the first roller sleeve connection element and/or the second roller sleeve connection element is formed disc-shaped, preferably as an annular disc. In particular, it is possible to form both roller sleeve connecting elements constructed in the same way as each other.

For a formation that also allows the transmission of greater torques, the drive transmission element connection arrangement may comprise a plurality of connecting members arranged mutually spaced in the circumferential direction about the roller axis of rotation, essentially extending in the direction of the roller axis of rotation and rigidly connected to the first drive transmission element and the second drive transmission element.

For a stable, weight-saving formation at least one, preferably every connecting member may be formed as a hollow section part. Furthermore, a simple assembly of a soil-processing roller constructed according to the invention may be supported in such a way that at least one, preferably every connecting member is removably connected to at least one, preferably every drive transmission element. Removably in the sense of the present invention means that this connection can be reversed without any destruction. For example, this connection may be achieved by screwed bolts or similar.

Also, considering the elasticity of the suspension elements and the thus enabled relative movement between the elastically-suspended system region of the soil-processing machine on the one hand and the drive transmission elements interconnected by the drive transmission element connection arrangement on the other hand, to avoid mutual contact it is proposed that on the roller sleeve at least one supporting disc is provided and at least one supporting disc allocated to at least one, preferably every connecting member exhibits a connecting member lead-through recess accommodating the connecting member with movement clearance and/or that the connecting members are arranged radially inside the roller sleeve connecting elements and at a radial spacing to the roller sleeve connecting elements. The movement clearance and/or the radial spacing is therefore of such a size that also, considering the greatest possible relative movement, mutual contact of the connecting members with the supporting discs and/or the roller sleeve connecting elements cannot arise.

In order also to guarantee an axial end region of the soil-processing roller removed from a roller drive motor, the second drive transmission element may be connected or connectable firmly so that it can rotate to a rotor region of a roller bearing unit for combined rotation about the roller axis of rotation.

In the direction of the roller axis of rotation, between the first drive transmission element and the second drive transmission element, a vibration mechanism with at least one out-of-balance mass may be arranged so that it can rotate about an out-of-balance axis of rotation and supported on the roller sleeve. Such a vibration mechanism, for example, constructed as a vibratory mechanism, provides for improved soil-processing characteristics by the periodic force and/or acceleration caused by this transferred to the roller sleeve.

A stator region of an unbalanced drive motor may be firmly connected to a stator region of the roller bearing unit, and a rotor region of the unbalanced drive motor may be connected to the at least one out-of-balance mass by a drive shaft, preferably a propeller shaft. This enables an exertion of a drive torque for the at least one out-of-balance mass also with firmly seated assembly of the unbalanced drive motor in relation to a machine frame. It is to be pointed out that the statement that, for example, the stator region of the unbalanced drive motor, for example, is firmly connected to a stator region of the roller bearing unit, does not necessarily mean that direct physical contact exists between these two regions. These may also be interconnected by using connecting components or modules firmly interconnected by the same.

A uniform suspension characteristic in both suspension regions may be supported in that the first elastic suspension elements are arranged sequentially in the circumferential direction about the roller axis of rotation, and that the second elastic suspension elements are arranged sequentially in the circumferential direction about the roller axis of rotation, preferably in several suspension element groups comprising respectively a plurality of suspension elements.

Particularly, for a uniform suspension characteristic, a quantity of the first elastic suspension elements may correspond to a quantity of the second elastic suspension elements. Furthermore, the first elastic suspension elements and the second elastic suspension elements may be arranged with the same arrangement pattern in relation to the roller axis of rotation. For example, this may be achieved in that the first and/or second suspension elements are arranged at a mutually-corresponding radial distance to the roller axis of rotation and/or a mutually-corresponding circumferential distance in relation to adjacent suspension elements respectively in the circumferential direction. The first and/or second suspension elements arranged with the same arrangement pattern, therefore, do not necessarily have to be arranged symmetrically to each other, but each one formation of suspension elements providing such a pattern may be twisted in relation to the other formation about the roller axis of rotation. For an even greater symmetrical suspension characteristic, it may be provided that the first elastic suspension elements and the second elastic suspension elements are arranged reflection symmetrically in relation to a plane of symmetry essentially orthogonal to the roller axis of rotation.

For a uniform load distribution and/or effective characteristic of the soil-processing roller in the direction of the roller axis of rotation, it is further proposed that an axial distance of the first drive transmission element and an axial distance of the second drive transmission element to a longitudinal center of the roller sleeve to each other are essentially equal, and/or that an axial distance of the first roller sleeve connecting element and an axial distance of the second roller sleeve connecting element to the longitudinal center of the roller sleeve to each other are essentially equal. Therefore, in relation to the longitudinal center of the roller sleeve and/or the soil-processing roller, an essentially symmetrical structure with regard to the arrangement of the component providing the torque exertion into the roller sleeve on the one hand and/or the suspension of the roller sleeve on the other hand and therefore also a symmetrical load distribution is achieved.

The present invention furthermore relates to a soil-processing machine comprising a soil-processing roller with the structure according to the invention supported on a machine frame so that it can rotate about a roller axis of rotation.

In so doing, for example, a rotor region of a roller drive motor may be connected firmly such that it can rotate to the first drive transmission element for combined rotation about the roller axis of rotation, and a stator region of the roller drive motor can be fastened to a first longitudinal member of the machine frame extending in a longitudinal direction of the machine.

Also to be able to achieve a stable support in relation the machine frame in the other axial end region of the soil-processing roller, it is proposed that a stator region of the roller bearing unit is established on a second longitudinal member of the machine frame extending in the longitudinal direction of the machine.

In particular, in the structure of the soil-processing machine as a so-called roller tractor, the machine frame with the soil-processing roller supported such that it can rotate about the roller axis of rotation may be essentially provided with a front end, wherein the front end is connected by means of a steering linkage arrangement to a rear end such that it can be swivelled about a steering axis, and wherein on the rear end a drive unit is supplied to provide the drive energy for the roller drive motor.

The present invention will be described in detail in the following in relation to the appended figures. In which.

Figure 1:
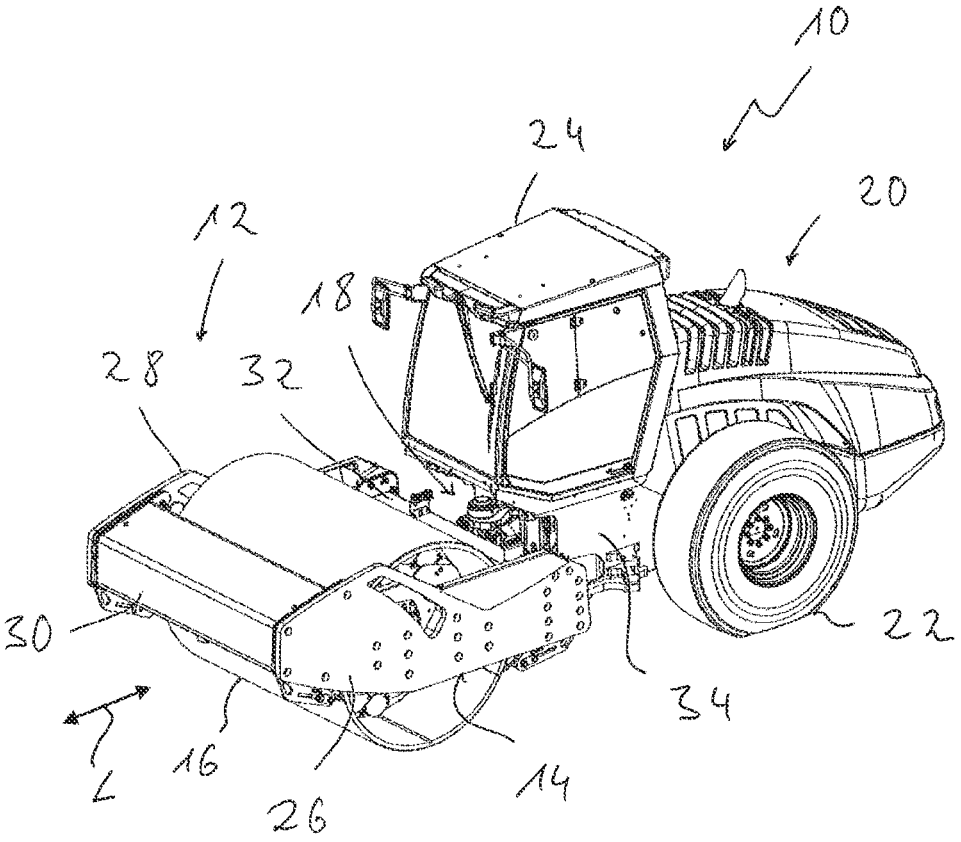
Fig. 1 PRIOR ART
FIG. 1 shows a soil compactor known from the prior art.
Figure 2:
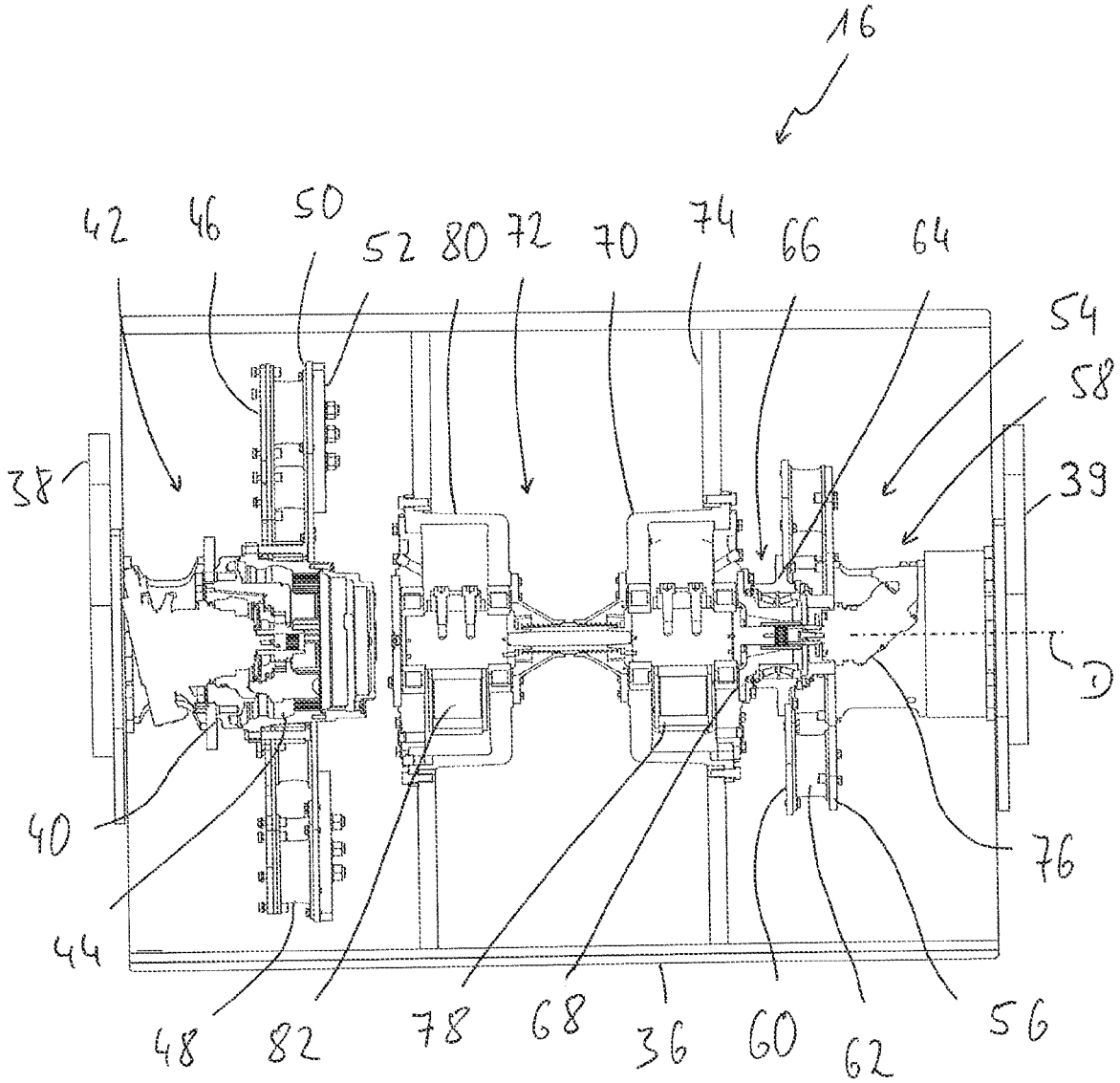
Fig. 2 PRIOR ART
FIG. 2 shows a soil-processing roller of the soil compactor of FIG. 1 in a longitudinal cross-section.

In the following, with reference to FIGS. 3 to 6, the structure of a soil-processing roller constructed according to the invention and/or a soil-processing machine equipped with it, for example, a soil compactor, is described. In the following description, components or modules that correspond with respect to the structure and/or function above with reference to FIGS. 1 and 2 are designated with the same reference numbers. Furthermore, it is to be noted that the fundamental structure of a soil-processing machine, so, for example, a soil compactor, in which the soil-processing roller constructed according to the invention may be used, may correspond to the structure described above with reference to FIG. 1. Therefore, in the context of the structure according to the invention of a soil-processing machine, reference may be made to the general description of the soil-processing machine 10 illustrated in FIG. 1.

Figure 3:
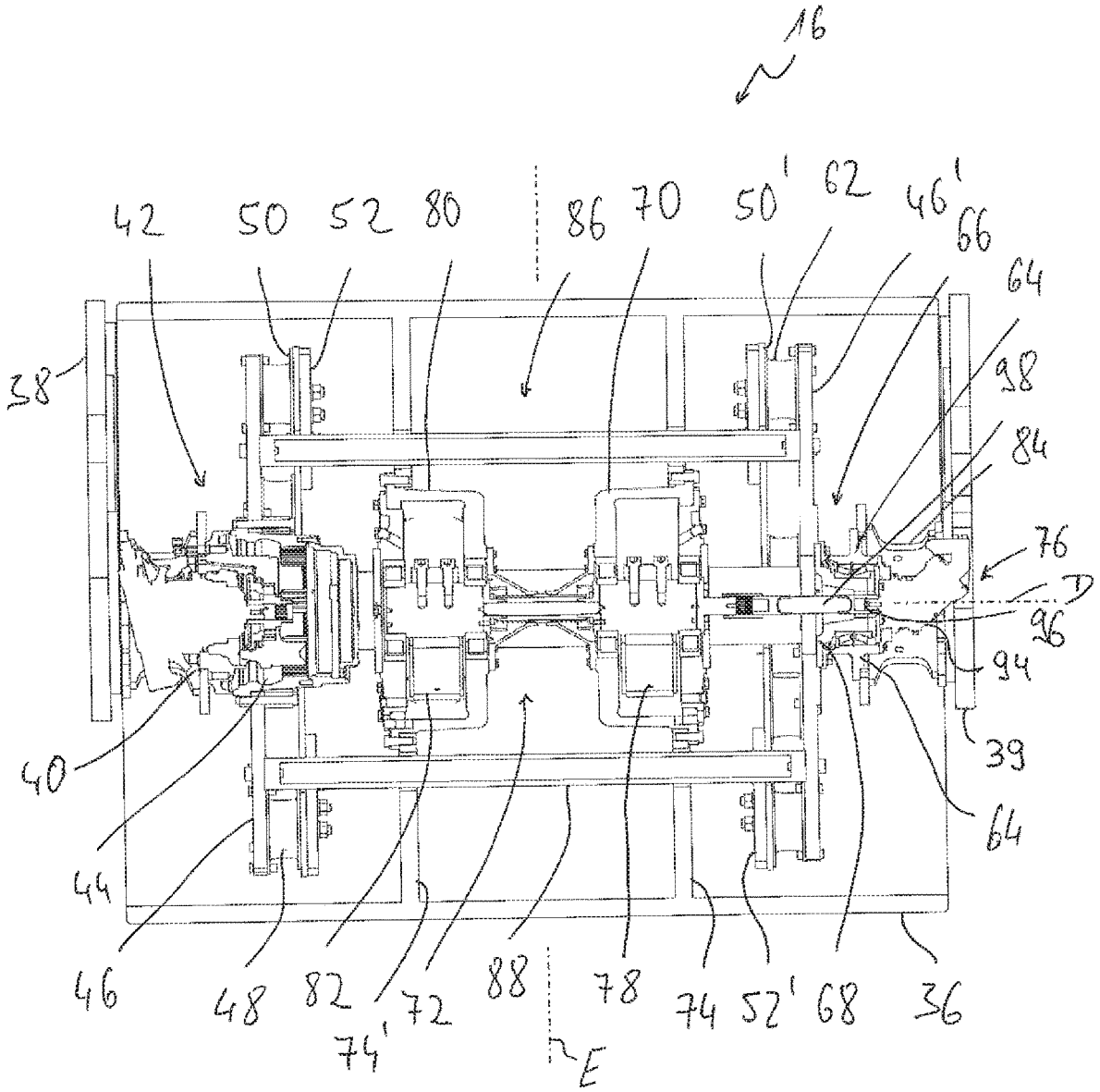
FIG. 3 shows a soil-processing roller constructed according to the invention in longitudinal cross-section.

FIG. 3 shows, in a way corresponding to FIG. 2, a longitudinal cross-section of a soil-processing roller 16 constructed according to the invention. This too comprises a roller sleeve 36. This is formed in the illustrative example shown in FIG. 3 with a smooth, enclosed circumferential contour and therefore is particularly suitable for compacting the ground. If, for example, with such a soil-processing roller 16 solid ground is to be broken up, the roller sleeve 36 may be formed with a structured and/or open circumferential contour.

Inside the roller sleeve 36 two supporting discs 74 and/or 74' are provided at a mutual axial distance, on which the housings 70, 80, already described above also with reference to FIG. 2, of the vibration mechanism 72 are supported. Inside the housings 70, 80, the out-of-balance masses 78, 82, for example, are supported so that they can rotate about the roller axis of rotation D.

A stator region 40 of a roller drive motor 42, also formed here, for example, as a hydraulic motor, is supported on the mounting plate 38 and by this onto the longitudinal member 28 of the machine frame 14. A rotor region 44 of the roller drive motor 42 supports a first drive transmission element 46 formed as an annular disc. This is, for example, fastened by screwing onto the rotor region 44.

Figure 4:
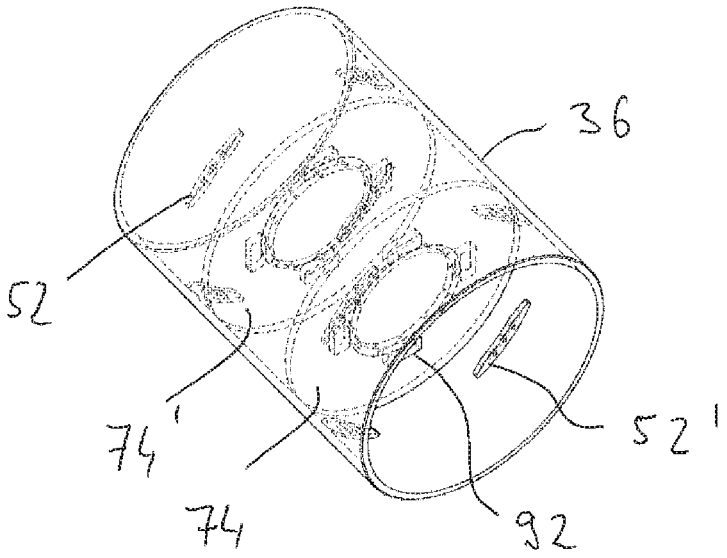
FIG. 4 shows a perspective, transparent view of a roller sleeve of the soil-processing roller of FIG. 3 with the supporting discs provided thereon
Figure 5:
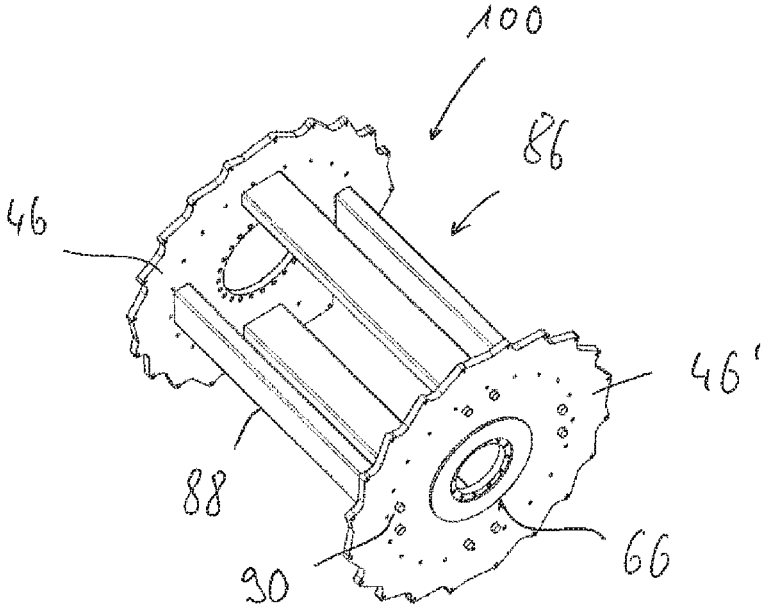
FIG. 5 shows a perspective of a drive cage of the soil-processing roller of FIG. 3.
Figure 6:
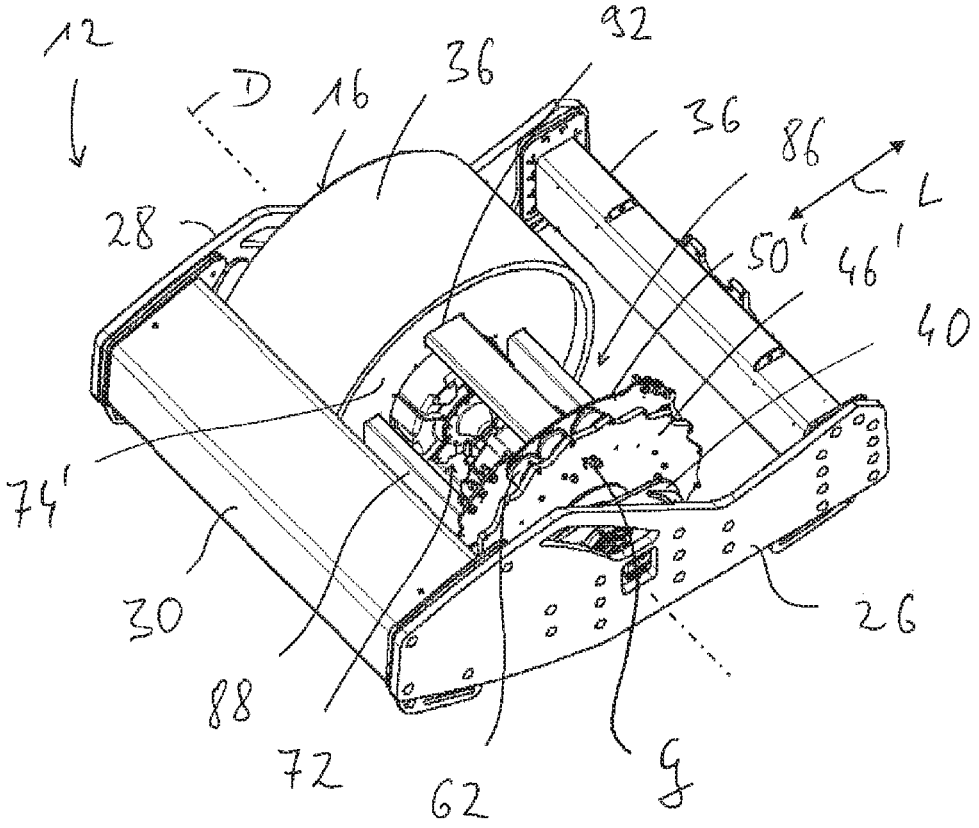
FIG. 6 shows a front end of a soil-processing machine with the soil-processing roller of FIG. 3 sometimes shown open.

In the radially external region, the first drive transmission element 46 is, for example, connected by screwing to several first elastic suspension elements 48 arranged sequentially in the circumferential direction. In turn, these are, for example, connected by screwing to a first roller sleeve connecting element 50 formed as an annular disc and/or may be held by screwing between the first drive transmission element 46 and the second roller sleeve connecting element 50. FIG. 4 shows the fastening protrusions 52 provided on the inside of the roller sleeve 36 at several circumferential positions, in which region the first roller sleeve connecting element 50 can be connected by screwing to the roller sleeve 36.

In the end region of the soil-processing roller 16 illustrated on the right in FIG. 3, a second drive transmission element 46' is provided formed as a disc or an annular disc. In its radially internal region, the second drive transmission element 46' is firmly connected, for example, by screwing to a rotor region 68 of a roller bearing unit 66. A stator region 64 of the roller bearing unit 66 is fastened by an annular support 84 to the mounting plate 39 and supported by this, for example, on the longitudinal member 26 of the machine frame 14.

In its radially external region, the second drive transmission element 46' is connected by a plurality of two elastic suspension elements 62 to a second annular disc-shaped roller sleeve connecting element 50'. Even in this case, for example, the sequential second elastic suspension elements 62 in the circumferential direction may be connected by screwing to the second drive transmission element 46' and the second roller sleeve connecting element 50' and/or held between them. The second roller sleeve connecting element 50' may be fastened by screwing to several fastening protrusions 52' provided on the internal circumference of the roller sleeve 36, so that also in the axial end region shown in FIG. 3 on the right, the soil-processing roller 16 is suspended elastically.

It can be seen that in both axial end regions the modules provided for suspending the soil-processing roller 16, therefore particularly the roller sleeve connecting elements 50, 50', the elastic suspension elements 48, 62 and the drive transmission elements 46, 46' are constructed essentially the same as each other and particularly are arranged at the same distance from a plane of symmetry E defining a longitudinal center of the soil-processing roller 16 and/or the roller sleeve 36, orthogonal to the roller axis of rotation D. The consequence of this is that in both suspension regions, suspension characteristics that are actually identical to each other may be provided. This symmetrical suspension characteristic may be supported in that the first and second elastic suspension elements 48, 62 are provided with arrangement patterns that are respectively identical to each other. This means that the sequence of the first elastic suspension elements 48 and the second elastic suspension elements 62 may correspond to each other in the circumferential direction, therefore identical circumferential distances and/or equal variations in the circumferential distance of suspension elements arranged, for example, in groups G with a small circumferential distance between sequential suspension elements, and also the distance to the roller axis of rotation D is selected as the same. Particularly, the first elastic suspension elements 48 and the second elastic suspension elements 62 are arranged in relation to the plane of symmetry E reflection-symmetrical to each other.

Both drive transmission elements 46, 46' are rigidly connected by a drive transmission element connection arrangement generally designated with 86 for torque transmission. The drive transmission element connection arrangement 86 clearly recognisable in FIG. 5 comprises several, four in the example illustrated, connecting members 88 sequential in the circumferential direction. These may, as indicated in FIG. 3, be constructed as hollow section parts closed in their axial end regions. In their axial end regions, the connecting members 88 are connected for provision of a fundamentally removable, but also rigid connection to the two drive transmission elements 46, 46', for example, respectively by several screwed bolts 90 to the drive transmission elements 46, 46' and from a drive cage 100 together with these.

The connecting members 88 are positioned in such a way that they are positioned radially inside the annular-disc formed and rigidly connected to the roller sleeve 36 roller sleeve connecting elements 50, 50'. Also to avoid a mutual disruption with the supporting discs 74, 74' provided in the further centrally-situated region of the roller sleeve 36, in this, lead-through holes 92 offset from the connecting members 88 with movement clearance may be provided. The size of these lead-through holes 92 on the one hand and the positioning of the connecting members 88 in relation to the roller sleeve connecting elements 50, 50' on the other hand are selected in such a way that also considering the greatest possible relative movement of the roller sleeve 36 permitted in relation to the drive transmission elements 46, 46' and/or the connecting members 88 due to the elastic property of the suspension elements 48, 62, mutual contact of the connecting members 88 with the roller sleeve connecting elements 50, 50' and the supporting discs 74, 74' cannot occur.

Furthermore, it can be seen in FIG. 3 that at the stator region 64 of the roller bearing unit 66 a stator region 94 of an unbalanced drive motor 76 is fastened. A rotor region 96 of the unbalanced drive motor 76 drives, for example, by a drive shaft 98 formed as a propeller shaft, both out-of-balance masses 78, 82 of the vibration arrangement 72. Therefore, the unbalanced drive motor 76 is also supported on the rigid system region of the soil-processing roller 16 in relation to the machine frame 14 and is not supported on the system region suspended elastically with the roller sleeve 36. Even this contributes to a uniform weight distribution, particularly in the elastically-suspended system region of the soil-processing roller 16.

It is to be pointed out that obviously by using the principles of the present invention on such a soil-processing roller 16, the most diverse structural variations may arise. So, for example, the drive transmission connection arrangement 86 may exhibit a different quantity of connecting members 88. Also, the elastic suspension of the roller sleeve 36 may be done at more than two regions arranged at an axial distance and preferably symmetrically arranged in relation to a longitudinal center region, this defined by a plane of symmetry E. So, for example, in the central region of the soil-processing roller 16 a further drive transmission element may be arranged which is connected by a further roller sleeve connecting element to the roller sleeve and to this by further elastic suspension elements. This centrally-arranged drive transmission element may be rigidly connected by respectively-segmented connecting members to the drive transmission element 46 position to the left of it in FIG. 3 and the drive transmission element 46' positioned to the right of it in FIG. 3, so that, as this is also the case in the illustrative example of FIG. 3, to provide an inherently rigid drive cage 100 by which in both axial end regions the soil-processing roller 16 is supported so that it can rotate with respect to the machine frame with suspension formations that are essentially of identical construction.

The invention claimed is:

1. Soil-processing roller for a soil-processing machine, comprising:

A roller sleeve extending in the direction of a roller axis of rotation surrounding the roller axis of rotation, A first drive transmission element connected to a rotor region of a roller drive motor for a combined rotation about the roller axis of rotation therewidth, A first roller sleeve connecting element connected to the first drive transmission element by means of a plurality of first elastic suspension elements and connected firmly so that it can rotate to the roller sleeve for combined rotation about the roller axis of rotation, A second drive transmission element arranged at an axial distance to the first drive transmission element and connected by means of a drive transmission element connection arrangement to the first drive transmission element for torque transmission, and A second roller sleeve connecting element connected to the second drive transmission element by means of a plurality of second elastic suspension elements and connected to the roller sleeve for a combined rotation about the roller axis of rotation therewith.

2. Soil-processing roller according to claim 1, wherein the first drive transmission element and/or the second drive transmission element and/or the first roller sleeve connecting element and/or the second roller sleeve connecting element is formed disc-shaped.

3. Soil-processing roller according to claim 1, wherein in the direction of the roller axis of rotation, between the first drive transmission element and the second drive transmission element, a vibration mechanism with at least one out-of-balance mass is arranged so that it can rotate about an out-of-balance axis of rotation and supported on the roller sleeve.

4. Soil-processing roller according to claim 1, wherein a uniform suspension characteristic in both suspension regions is supported in that the first elastic suspension elements are arranged following one after the other in the circumferential direction around the roller axis of rotation, and that the second elastic suspension elements are arranged sequentially in the circumferential direction about the roller axis of rotation.

5. Soil-processing roller according to claim 1, wherein a quantity of the first elastic suspension elements corresponds to a quantity of the second elastic suspension elements and/or that the first elastic elements and the second elastic elements are arranged with the same arrangement pattern in relation to the roller axis of rotation and/or that the first elastic suspension elements and the second elastic suspension elements are arranged reflection-symmetrically in relation to a roller axis of rotation in a substantially orthogonal plane of symmetry.

6. Soil-processing roller according to claim 1, wherein an axial distance of the first drive transmission element and an axial distance of the second drive transmission element to a longitudinal center of the roller sleeve to each other are substantially equal, and/or that an axial distance of the first roller sleeve connecting element and an axial distance of the second roller sleeve connecting element to the longitudinal center of the roller sleeve to each other are substantially equal.

7. Soil-processing roller according to claim 1, wherein the drive transmission element connection arrangement comprises a plurality of connecting members arranged mutually spaced in the circumferential direction about the roller axis of rotation, substantially extending in the direction of the roller axis of rotation and rigidly connected to the first drive transmission element and the second drive transmission element.

8. Soil-processing roller according to claim 7, wherein at least one connecting member is formed as a hollow section part and/or is connected removably with at least one drive transmission element.

9. Soil-processing roller according to claim 7, wherein, on the roller sleeve at least one supporting disc is provided and at least one supporting disc is allocated to at least one connecting member exhibits a connecting member lead-through recess taking up the connecting member with movement clearance, and/or that the connecting member is arranged radially inside the roller sleeve connecting elements and with radial distance from the roller sleeve connecting elements.

10. Soil-processing roller according to claim 1, wherein the second drive transmission element is connected or connectable such that it can rotate with a rotor region of a roller bearing unit for combined rotation about the roller axis of rotation.

11. Soil-processing roller according to claim 10, wherein, in the direction of the roller axis of rotation, between the first drive transmission element and the second drive transmission element, a vibration mechanism with at least one out-of-balance mass is arranged so that it can rotate about an out-of-balance axis of rotation and supported on the roller sleeve, and further wherein a stator region of an unbalanced drive motor is firmly connected to a stator region of the roller bearing unit, and a rotor region of the unbalanced drive motor is connectable to the at least one out-of-balance mass by a drive shaft.

12. Soil-processing machine comprising a soil-processing roller supported on a machine frame such that it can rotate about a roller axis of rotation, the soil-processing roller including:

A roller sleeve extending in the direction of the roller axis of rotation surrounding the roller axis of rotation, A first drive transmission element connected to a rotor region of a roller drive motor for a combined rotation about the roller axis of rotation therewith, A first roller sleeve connecting element connected to the first drive transmission element by means of a plurality of first elastic suspension elements and connected firmly so that it can rotate to the roller sleeve for combined rotation about the roller axis of rotation, A second drive transmission element arranged at an axial distance to the first drive transmission element and connected by means of a drive transmission element connection arrangement to the first drive transmission element for torque transmission, and A second roller sleeve connecting element connected to the second drive transmission element by means of a plurality of second elastic suspension elements and connected to the roller sleeve for a combined rotation about the roller axis of rotation therewith.

13. Soil-processing machine according to claim 12, wherein a rotor region of a roller drive motor is connected firmly such that it can rotate to the first drive transmission element for combined rotation about the roller axis of rotation, and a stator region of the roller drive motor is fastenable to a first longitudinal member of the machine frame extending in a longitudinal direction of the machine.

14. Soil-processing machine according to claim 12, wherein the second drive transmission element is connected or connectable such that it can rotate with a rotor region of a roller bearing unit for combined rotation about the roller axis of rotation, and wherein a stator region of the roller bearing unit is fastened to a second longitudinal member of the machine frame extending in the longitudinal direction of the machine.

15. Soil-processing machine according to claim 12, wherein the machine frame with the soil-processing roller supported such that it can rotate about the roller axis of rotation is provided with a front end, wherein the front end is connected by means of a steering linkage arrangement to a rear end such that it can be swivelled about a steering axle, and wherein on the rear end a drive unit is supplied to provide the drive energy for the roller drive motor.

* * * * *